United States Patent [19]

Downey

[11] 4,267,430

[45] May 12, 1981

[54] DUAL-VOLTAGE ELECTRIC HAIR CURLING APPARATUS AND VANITY CASE THEREFORE

[76] Inventor: John H. Downey, 1262 Don Mills Rd., Suite 88, Don Mills, Ontario, Canada, M3B 2W7

[21] Appl. No.: 949,058

[22] Filed: Oct. 6, 1978

[51] Int. Cl.[3] ..... A45D 2/00; H05B 1/00

[52] U.S. Cl. ..... 219/222; 132/9; 132/37 R; 219/225; 219/240; 219/242; 219/255; 219/486; 219/488; 219/517; 219/537; 312/224; 339/154 R; 362/136

[58] Field of Search ..... 219/222–242, 219/249, 250, 255, 256, 257, 439, 483–488, 504, 505, 537, 539, 200, 201; 339/154 R; 132/37 R, 37 A, 31 R, 31 A, 32 R, 32 A, 33 R, 9, 11; 312/224; 362/136

[56] References Cited

U.S. PATENT DOCUMENTS

| | | | |
|---|---|---|---|
| 1,930,244 | 10/1933 | Lewinsohn et al. | 362/136 |
| 2,060,929 | 11/1936 | De Los Santos | 219/488 |
| 2,215,029 | 9/1940 | Braun | 219/256 X |
| 2,277,605 | 3/1942 | Palitzsch | 219/439 |
| 2,480,337 | 8/1949 | Pearce | 219/488 |
| 2,553,274 | 5/1951 | Pohl | 219/517 X |
| 2,636,972 | 4/1953 | Graham | 219/486 X |
| 3,095,493 | 6/1963 | Downing | 219/255 X |
| 3,130,289 | 4/1964 | Katzman et al. | 219/240 X |
| 3,473,004 | 10/1969 | Block et al. | 219/242 X |
| 3,534,392 | 10/1970 | Trouilhet | 132/37 R X |
| 3,622,746 | 11/1971 | Trouilhet | 219/225 |
| 3,626,150 | 12/1971 | Kress | 219/222 |
| 4,097,718 | 6/1978 | Weise | 219/225 X |

FOREIGN PATENT DOCUMENTS

| | | | |
|---|---|---|---|
| 167679 | 2/1951 | Austria | 219/240 |
| 1289545 | 2/1962 | France | 219/240 |
| 423109 | 1/1935 | United Kingdom | 362/136 |
| 1004526 | 9/1965 | United Kingdom | 339/154 R |

*Primary Examiner*—A. Bartis

[57] ABSTRACT

A dual-voltage electric hair curling apparatus includes a having a handle and a heated barrel. A pair of positive temperature coefficient (PTC) heating elements are located in the barrel and are operable, respectively, at a low automotive vehicle voltage and a high domestic voltage. A switch in the handle permits energization of either heating element dependent upon the voltage of the available power supply and an overload fuse prevents damage to the low voltage heater should it be accidently energized from a high voltage supply. The curler is provided with a power cord terminating in a two-pronged plug receivable into a corresponding receptable on a portable vanity case adapted to be mounted by clips to the visor of an automotive vehicle. The vanity case has a mirror illuminated by electric luminaires on its front surface and a cord set terminating in a plug receivable in an automobile cigar lighter is connected to the receptable and luminaires. When not in use the hair curler, power cord and cord set are stored in a compartment in the vanity.

3 Claims, 10 Drawing Figures

FIG.1.
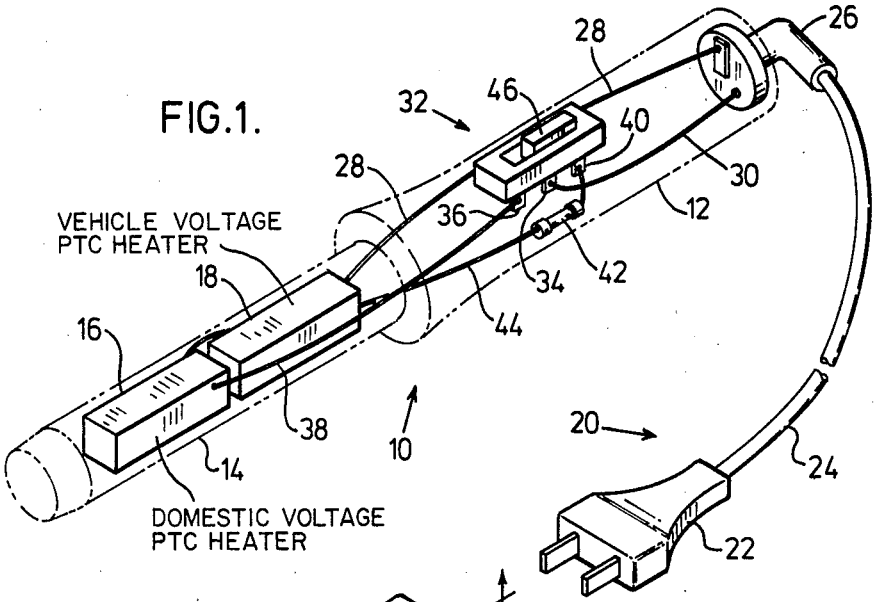
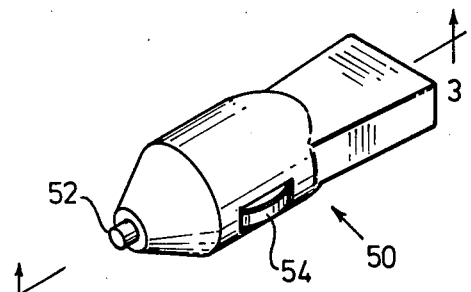
FIG.2.
FIG.3.
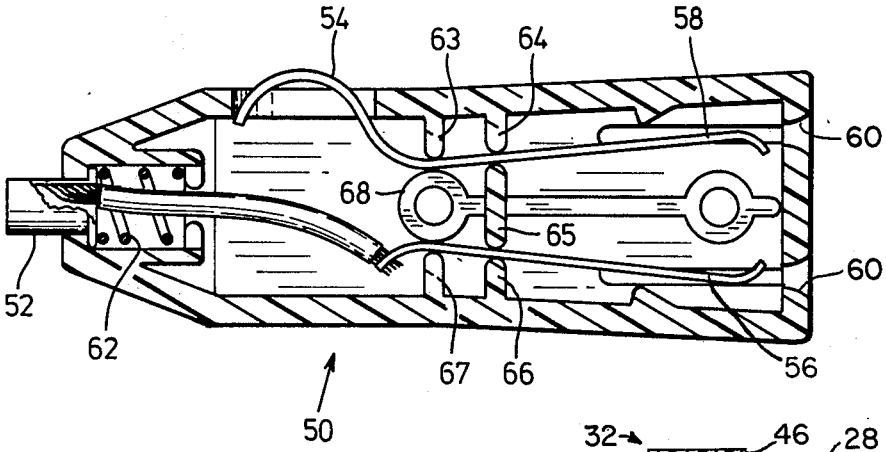
FIG.10.
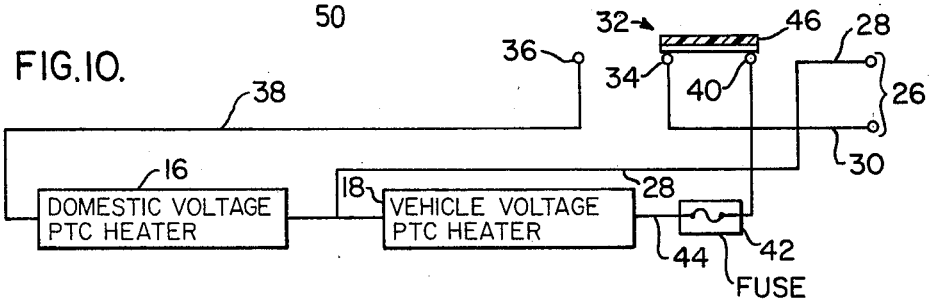

FIG. 6.
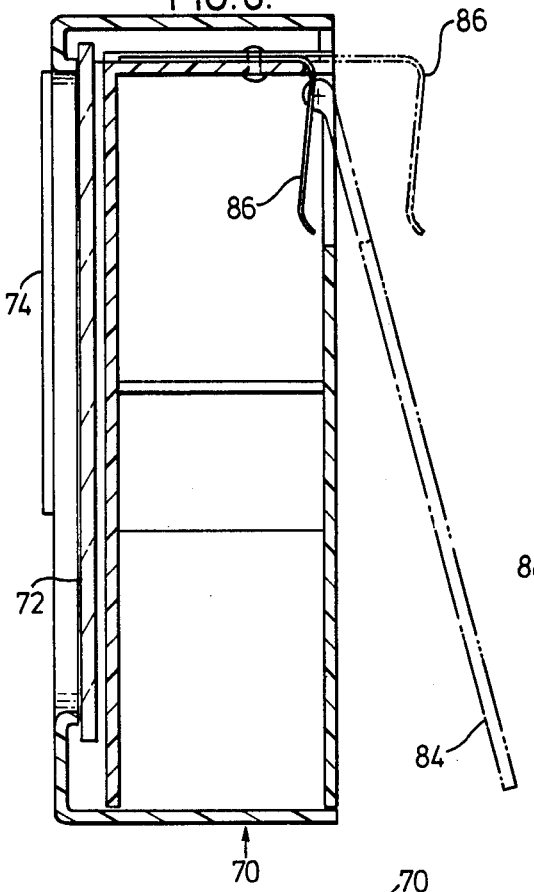
FIG. 7.
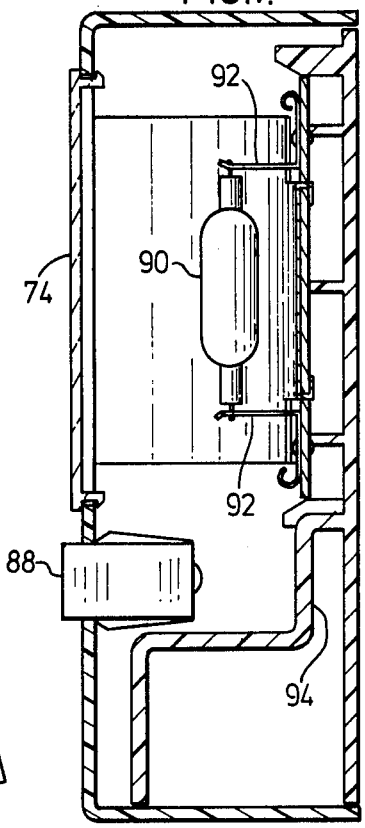
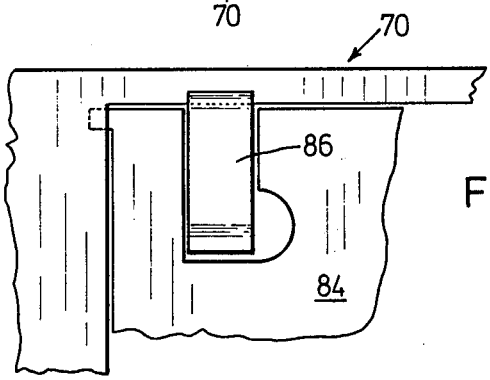
FIG. 8.
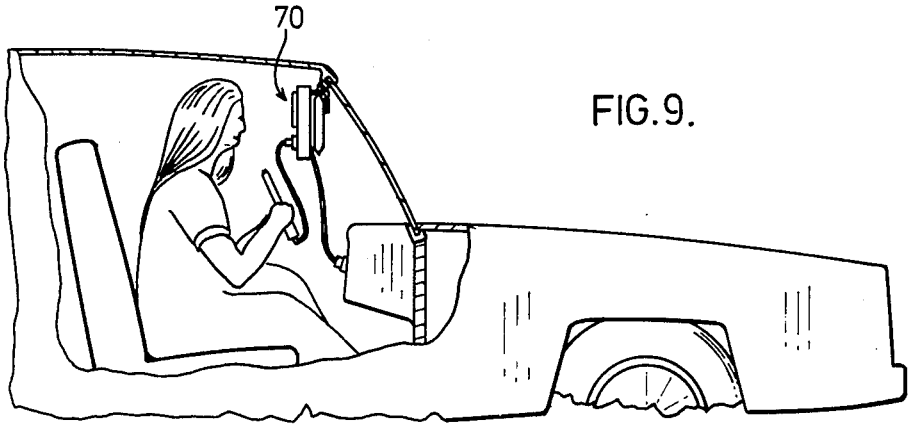
FIG. 9.

DUAL-VOLTAGE ELECTRIC HAIR CURLING APPARATUS AND VANITY CASE THEREFORE

BACKGROUND OF THE INVENTION

This invention is directed to an electrically heated hair curler, and in particular to a curler having at least a dual operating voltage range.

The use of dual voltage range appliances is well known, such as battery and a-c/d-c mains operated radios.

In the case of hair curlers U.S. Pat. No. 3,473,004 Block et al, Oct. 14th, 1969 shows a portable curling arrangement having a base unit provided with removeable curlers, heating of the curlers taking place when mounted on the base. The curlers are removeable from the base, for rolling into the hair of a user.

The base supply unit is provided with a low-voltage distribution arrangement for use with a battery supply, together with a transformer permitting connection to domestic a-c mains supply. The heating arrangement comprises a plurality of removeable rollers each making contact with low voltage contacts in the base and having a resistance heater within the interior of the curler body.

This prior arrangement suffers from the disadvantage of; undue weight owing to the incorporation of a transformer; the necessity for a low voltage and a high voltage cord set, and the need to provide a plurality of curlers, each containing a heating element, but operable on the hair of user only when de-energised.

SUMMARY OF THE INVENTION

In accordance with the presently disclosed arrangement there is provided a single, light weight hair curling device having a single cord set for use with a first, low voltage automotive source of electric current, and with a second, high voltage source of electric current, namely domestic supply, first heater means operable at low voltage, second heater means operable at the second high voltage, and switch means selectively connecting the cord set with one or other of the heater means.

In order to permit use of the subject curling device with an automobile there is provided a cigar lighter adaptor insertable into an automotive cigar lighter and having a receptacle at the outer end thereof into which a two prong household male plug may be inserted. Thus the cord set including the household plug may be used with a household supply, or in combination with the adaptor may be used in an automobile equipped with a lighter socket.

A further embodiment features a portable case or vanity having an electrical outlet or receptacle, the case being equipped with an automotive electrical plug set, for use in an automobile cigar lighter and having a mirror, with luminaire lights flush mounted in the vanity therewith, and a plug-receiving electrical receptacle in the vanity into which the curling iron may be plugged, for use at low voltage.

The portable case is provided with a visor clip for mounting the case on the interior visor of a car, the case also having a storage compartment to contain the cord set of the case and also the curler and its cord set.

DESCRIPTION OF THE DRAWINGS

Certain embodiments of the invention are described, reference being made to the accompanying drawings, wherein;

FIG. 1 is a general view of a portable curling iron having a unitary cord set, in accordance with this invention;

FIG. 2 is a general view of an automotive cigar lighter plug-in adaptor;

FIG. 3 is a cross sectional view of the plug-in adaptor taken in the plane 3—3 of FIG. 2;

FIG. 6 is a sectional end elevation view of the case taken in the plane 6—6 of FIG. 5;

FIG. 7 is a sectional end elevation of the case, taken in the section 7—7 of FIG. 4;

FIG. 8 is a view in the direction 8 of a portion of case shown in FIG. 5, showing a visor clip;

FIG. 9 is a schematic view, in profile of a user utilizing the combination of the curler and vanity when seated in an automobile, and FIG. 10 is a circuit diagram for the circuit of FIG. 1.

DESCRIPTION OF THE INVENTION

Figure 4:
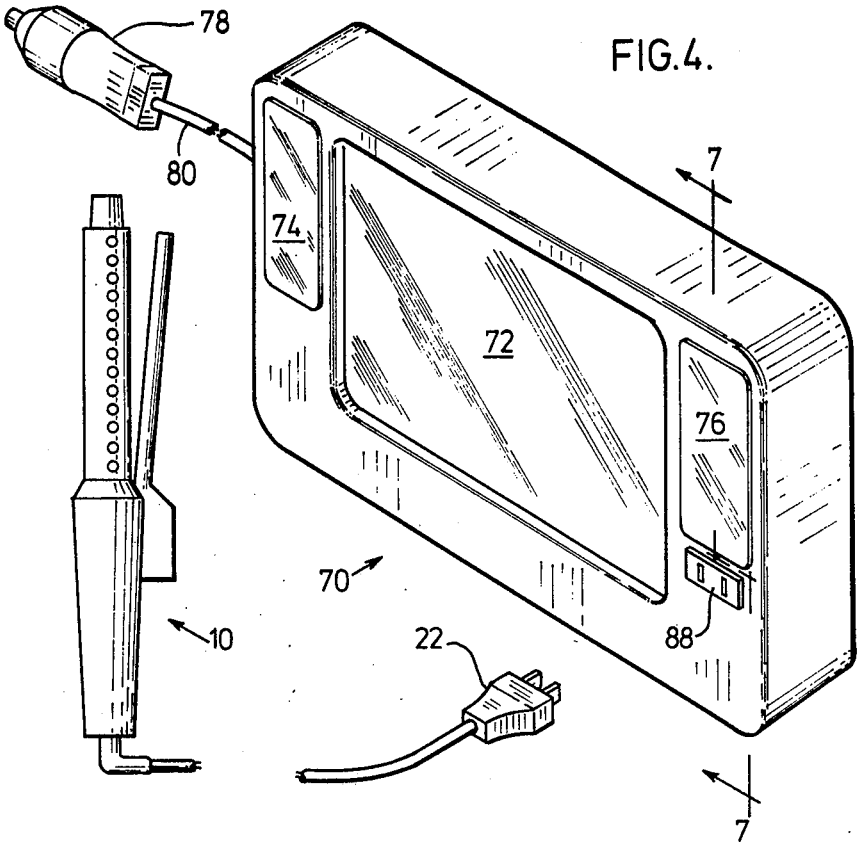
FIG. 4 is a general view showing a portable vanity case as disclosed herein, including the cord set thereof having an automotive plug-in adaptor, in combination with the presently disclosed curler iron.

Referring to FIG. 1, the curler 10 has an elongated handle 12 shown in phantom, having a barrel portion 14 extending therefrom.

The curler barrel portion 14 contains a high voltage thermistor 16 for use with domestic supply voltage and a low voltage thermistor for use with automotive supply voltage. The thermistor 16, 18 are illustrated as being physically separated longitudinally in the barrel 14.

Twin conductor cord set 20 has a standard 2-pin connector 22 connected by way of flexible cord 24 with pivotal connector 26 mounted in the end of the handle 12.

Referring also to FIG. 10, one conductor 28 connects with the earth side, so-called, of both thermistor 16, 18. The other supply conductor 30 connects with a two-way switch 32, at the centre post 34 thereof. The forward post 36 of switch 32 connects by way of conductor 38 with the high voltage thermistor 16.

The rear post 40 of switch 32 is connected by way of current limiting fuse 42 and conductor 44 with the low voltage thermistor 18. With the slide 46 of switch 32 in the rearward position, illustrated in FIG. 1, which is for automotive use the centre post 34 is connected in series with the rear post 40 so as to produce energization of the low voltage thermistor 18 when the plug 22 is activated by connection to a source of electrical supply.

In the event that the curling iron 10 is plugged into a domestic 115 volt or 230 volt supply at this juncture, the fuse 42 will open circuit, so as to electrically isolate one side of the low voltage thermistor 18, to thereby protect the thermistor 18 against breakdown due to the overvoltage.

With the slide 46 in the forward position, the centre post 34 is connected in series with the front post 36, so as to produce energisation of the high voltage thermistor 16 when the plug 22 is activated by connection to a source of electrical supply.

The thermistor 16, 18 are positive temperature coefficient (PTC) thermistor, the insulation system of the iron being rated to 230 volts, so that the iron 10 may be safely used with North American domestic supply voltage 115 volts (nominal) without any change in the high voltage thermistor 16 which is inherently self regulating so as to require no thermistor controls.

Referring to FIGS. 2 and 3, the automotive adaptor 50 provides connection for the plug 22 with the socket for the cigar lighter in an automobile and is provided with a center post contact 52 and wall contact 54 for making contact with the automobile socket when inserted therein. A pair of internal slipper contacts 56,58 are respectively connected to contacts 52 and 54 as shown to provide connections with the two contact pins or blades of the plug 22 when inserted into the adaptor 50. The post contact 52 and the wall contact 54 provide electrical connection of the adaptor 50 with the vehicle power supply when inserted into the cigar lighter receptacle.

The adaptor 50 has a pair of apertures 60 to receive the pins of the plug 22, when inserted therein, so as to be in wiping contact with the resilient slipper contacts 56, 58.

Other details of the adaptor 50 include a biassing spring 62 for the centre contact 52 to ensure contact with the vehicle socket. An arrangement of conductor positioning ribs 63,64,65,66 and 67, and a spacer 68 serve to locate the conductors 54 and 56 in their respective internal locations and complete the interior arrangements of the adaptor 50.

Figure 5:
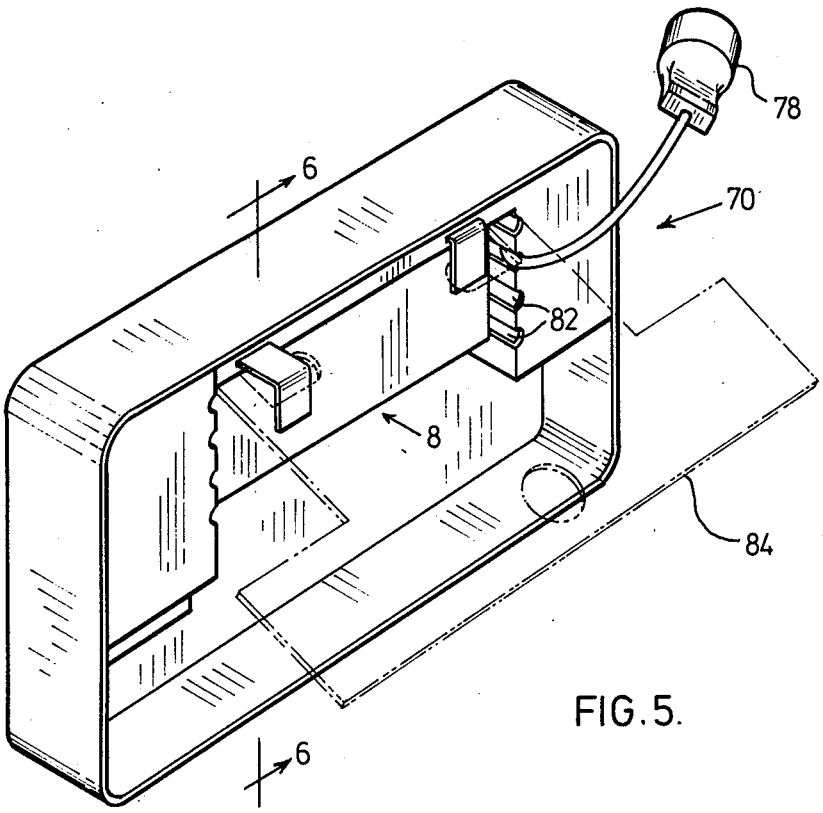
FIG. 5 is a general view of the vanity showing the compartmentized structure thereof, the visor slide in clips, and the rear cover in phantom.

Turning to FIGS. 4 and 5, the portable vanity case 70 has a mirror 72 with adjacent flush mounted lighting panels 74,76.

An automotive plug-in connector 78 of the usual type for use with a cigar lighter socket connects by way of cord 80 with the vanity case 70. A compartment having a series of spaced stretchers 82 permits orderly storage of the cord 80 and connector 78.

A pivotal cover 84, shown in phantom in FIG. 5, provides access to the interior of the case 70. Finger cut-outs in the cover 84 provide access to a pair of spaced apart visor clips 86, one of which is shown in phantom in an extendable position in FIG. 6.

Referring also to FIGS. 6, 7 and 8, the vanity 70 has a power socket 88 into which may be inserted the plug 22 of the iron 10.

The conductors of cord 80 are connected with the outlet socket 88 and also with a set of lamps 90, by way of contacts 92. Frosted panels 74 and 76 carried by snap-in clips cover the front case apertures within which the lamps 90 are located.

Interior wall 94 provides a stiffening structure to case 70 and forms with the case 70 a compartment in which the curler iron 10 may be stowed, together with its cord set, for compact portability.

In addition to providing a sectionalized interior structure for strength, lightness and rigidity, the cover 70 also provides carrying capacity for the associated components of the combination, and segregated interior zones in which the interior connections to the respective energised components such as lights 90 and power outlet 88 can be isolated.

While the subject curler 10 is selectively useable with automotive voltage (nominally 12 volts) or with domestic voltages of 115 volts or 230 volts, the portable vanity case is intended only for use with automotive voltages, and accordingly is provided only with an automotive plug-in so that its acciental or unauthorized use at high voltage with domestic supply cannot take place unwittingly.

The present arrangement provides multi-voltage utilisation of a curling iron at low cost and inherent simplicity and safety. The vanity additionally may provide storage space for tooth paste, as a convenient carrying medium for the user.

In use, it is contemplated that the combination permits maximum convenience to the user, who can commence their toilet at home and conveniently complete it by finishing off their coiffure in an automobile while proceeding to their destination, all with a maximum of convenience and safety.

What I claim is:

1. An electrically heated hair curling apparatus for use in an automobile vehicle said hair curling apparatus comprising an electrically heated hair curler having an elongated barrel portion attached to a handle portion, electric cord means attached to said handle portion for connecting the curler to an electrical supply, a positive temperature coefficient electrical heating means operable at automotive voltage located in said barrel portion for heating the barrel portion, and connection means connecting said heating means to said electric cord means; a portable case having exterior clip means at its rear for attachment thereof to an interior visor of a vehicle, a mirror located on the front surface of said case remote from said clip means, and at least one luminaire light on said case front surface adjacent said mirror for illumination of a user thereof and operable at automotive voltage; said electric cord means terminating in a plug, an electrical receptacle on said case for receiving said plug of said electric cord means in plugged-in relation therein, an automotive cord set connected to said luminaire light and said electrical receptacle for supplying electric power thereto at automotive voltage, said cord set having an electric plug for insertion into a cigar lighter of said vehicle, and at least one storage compartment in said case accessible through an opening in a wall of said case for receiving and holding said hair curler, cord means and said automotive cord set in stored relation therein when not in use.

2. The combination as claimed in claim 1, said hair curler including a second positive temperature coefficient electric heating means in said barrel operable on domestic voltage supply, said curler electric cord means having a domestic voltage style two prong plug permitting use of said curler independently of said vehicle, said receptacle receiving said two prong plug, said hair curler connection means including switch means operable in a first position to connect said curler electric cord means to said automotive voltage heating means, and operable in a second position to connect said electric cord means to said domestic voltage heating means and means connected in series relation with said automotive voltage heating means to protect it against overvoltage in the event of the application of domestic supply thereagainst.

3. The combination as claimed in claim 1, said portable case including displaceable cover means over said casing opening providing access to said at least one storage compartment.

* * * * *